US005207446A

United States Patent [19]

Arnulf et al.

[11] Patent Number: 5,207,446

[45] Date of Patent: May 4, 1993

[54] CROSS COUNTRY SKI BINDING

[75] Inventors: Paul Arnulf, Alby sur Cheran; Emmanuel Jacquet, La Balme de Sillingy, both of France

[73] Assignee: Salomon S.A., Annecy Cedex, France

[21] Appl. No.: 702,380

[22] Filed: May 20, 1991

[30] Foreign Application Priority Data

May 21, 1990 [FR] France ..... 90 06506

[51] Int. Cl.[5] ..... A63C 9/18

[52] U.S. Cl. ..... 280/615; 280/634

[58] Field of Search ..... 280/614, 615, 631, 632, 280/634, 623, 627

[56] References Cited

U.S. PATENT DOCUMENTS

| | | | |
|---|---|---|---|
| 4,468,048 | 8/1984 | Wittmann et al. | 280/614 |
| 4,995,632 | 2/1991 | Girault et al. | 280/615 |
| 5,007,656 | 4/1991 | Girault et al. | 280/615 |
| 5,052,709 | 10/1991 | Girault et al. | 280/615 |
| 5,052,710 | 10/1991 | Provence et al. | 280/615 |
| 5,085,454 | 2/1992 | Provence et al. | 280/634 X |
| 5,092,620 | 3/1992 | Girault et al. | 280/615 |

FOREIGN PATENT DOCUMENTS

| | | | |
|---|---|---|---|
| 1190259 | 7/1985 | Canada . | |
| 2622966 | 4/1977 | Fed. Rep. of Germany | 280/615 |
| 3924018 | 2/1990 | Fed. Rep. of Germany | 280/615 |
| 2500312 | 8/1982 | France . | |
| 2642980 | 8/1990 | France . | |
| 2645761 | 6/1991 | France . | |

*Primary Examiner*—Brian Johnson

*Attorney, Agent, or Firm*—Sandler Greenblum & Bernstein

[57] ABSTRACT

Cross country ski binding of the type that includes a retention device for the tip of the boot. The retention device includes a channel having an upwardly facing opening and in which nests a transverse latching bar carried by the front of the boot. The channel includes a fixed portion and a movable portion, the movable portion being adapted to be spaced from the fixed portion by biasing a spring under the effect of a longitudinal force, which serves to free the bar.

19 Claims, 5 Drawing Sheets

CROSS COUNTRY SKI BINDING

BACKGROUND OF THE INVENTION

1. Field of the Invention

The present invention relates to a cross country ski binding.

More particularly, the invention relates to a binding which is adapted to assure the retention on the ski of the tip of a boot of the type comprising a transverse latching bar, which in this case, is a small cylindrical shaft whose two ends are embedded in the lateral portions extending from the sides of the sole. Such a boot, which is well known to cross country skiers, is in particular sold by the assignee under the commercial designations "SR" "SNS".

2. Description of Background and Relevant Information

The bindings which are adapted to this type of boot include retention means which comprise a trough, i.e., a small channel of a generally semi-cylindrical shape positioned transversely and whose opening is turned upwardly. The trough is adapted to receive the said latching bar by nesting from top to bottom.

A latch, which is maneuverable for insertion and removal of the boot from the binding, is provided to normally block the opening of the channel during skiing. The bar is thus maintained between the front and rear walls of the channel, under the latch, which ensures the retention at the tip of the shoe on the ski.

In the course of skiing, the transverse bar serves as a pivot axis for the boot on the ski, the front portion of the sole pressing an absorption element and restoring appropriate energy to the binding. The Absorption element comprises, for example, a bumper made of elastically deformable synthetic rubber.

In the bindings of the type described, the boot can only escape from the ski in a voluntary fashion, by opening of the latch (during removal of the boot). In the case of a fall, the tip of the shoe remains affixed to the ski, which can be dangerous for the skier in certain configurations of a fall, particularly, in those cases where there is a substantial torsional component, the flexibility of the shoe being then insufficient to compensate for the relative torsional movement between the leg and the ski.

SUMMARY OF THE INVENTION

It is for this reason that the present invention proposes an improvement in this type of binding for cross country skiing, by equipping it with a safety system which is adapted to assure the freeing of the boot, particularly, when an excess torsional force develops between the shoe and the ski, in particular during a fall of the skier.

Another objective of the invention is to provide that the safety system be not only effective with respect to safety, but at the same time be simple and not cumbersome and not cause any accidental freeing of the boot in the course of normal skiing.

These different results have been achieved according to the invention, by virtue of the fact that the channel which retains the latching bar is constituted of two portions, namely, a fixed portion and a movable portion, the movable portion being adapted to be spaced from the fixed portion, by biasing an elastic return means, under the effect of a longitudinal force, which serves to free the bar (and thus the boot). This longitudinal force can be produced in different configurations of a fall: frontward fall, rearward fall, torsional fall, alone or combined.

It is thus the rocking movement of the bar, for example, in a plane parallel to the ski in the case of a torsional moment, which will cause the relative spacing of the two channel portions.

Preferably, it is the rear portion of the channel which constitutes the movable portion, so as to avoid accidental releases which could take place by virtue of the substantial frontward pressures which can occur in the course of skiing.

A construction in which the front portion which is movable can also, however, be envisioned.

Preferably, the movable portion comprises a lower portion, substantially in the shape of a quarter of a cylinder (complementary to the bar) and this lower portion is connected to a disengagement surface which is upwardly and rearwardly inclined. Thus, beyond a certain retraction path of the movable portion, a disengagement space is created beneath the bar through which the bar can freely escape upwardly, despite the presence of the latch, which assures a clean freeing of the tip of the shoe.

In a first embodiment of the invention, the movable portion is carried by a lever which is journalled around a transverse axis, the spacing movement of the movable portion with respect to the fixed portion corresponding to a downward pivoting of the lever.

In a second embodiment, the movable portion is carried by a slide which can be translationally displaced along the longitudinal direction of the ski. In this case, those means are provided, preferably, which allow the slide to pivot laterally on the ski (around a vertical axis) after a certain longitudinal translational path, which assures that the bar is definitely accompanied by the movable portion of the channel, improving the efficiency of the release.

According to one additional characteristic of the invention, it has been provided to connect, functionally and kinematically, that portion of the movable channel and the latch which normally block the opening of the channel, this linkage being such that, when the movable portion is spaced from the fixed portion it causes the retraction of the latch, facilitating the possibility of the bar escaping outside of the channel.

BRIEF DESCRIPTION OF THE DRAWINGS

Other characteristics and advantages of the invention will appear from the annexed description and drawings in which.

DESCRIPTION OF THE PREFERRED EMBODIMENTS

Figure 1:
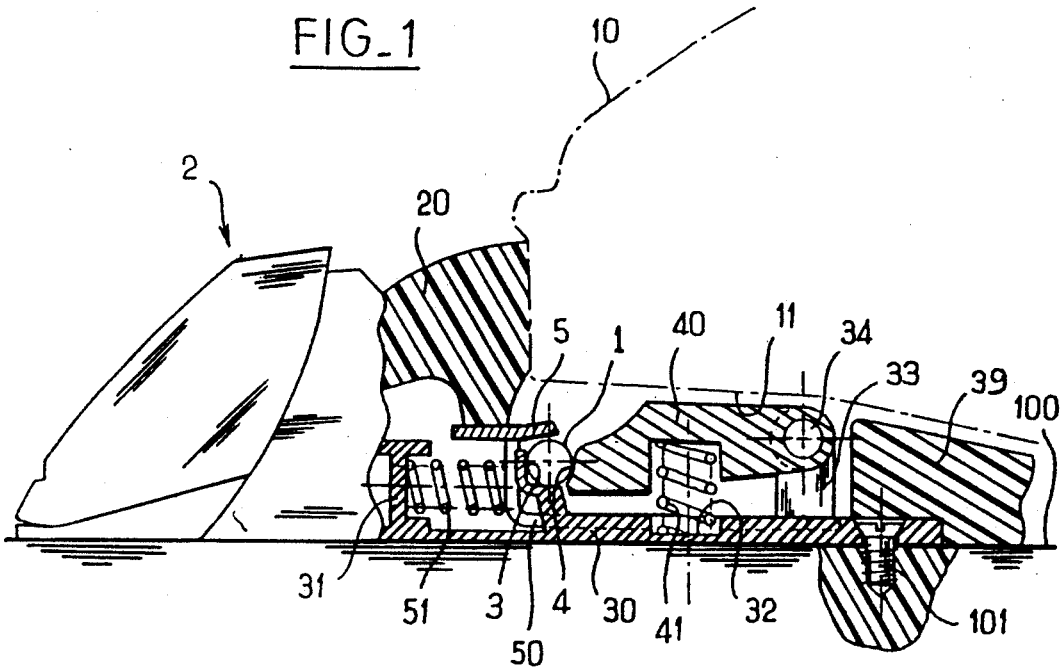
FIG. 1 is a side view, and a partial section, of a first embodiment of a binding according to the invention.

In FIG. 1 reference 10 designates the front portion of the shoe (shown in phantom lines) and reference 100 designates the ski of which only the upper surface has been shown.

Binding 2, which is affixed on the ski by appropriate means such as screws 01, comprises a bumper 20 for absorption and restoration of energy which, as is well known, is supported against the frontal surface of the sole.

The tip of the shoe is provided with a transverse bar 1, which is lodged in a channel whose opening is directed upwardly. A latch 5 normally blocks this opening. Latch 5 is constituted by a plate carried by a slide 50 which is translationally movable along the longitudinal axis of the ski. It is guided by appropriate means in the fixed base plate 30 of the binding. A spring 51, which is supported against a fixed portion 31, pushes slide 50 towards the rear of the ski (towards the right of FIG. 1). Appropriate means of a known type, which have not been shown so as to not unnecessarily complicate the present description, allow for the displacement of latch 5 frontwardly against a spring 51 so as to allow for insertion and removal of the shoe from the binding, in order to let the bar pass.

Figure 3:
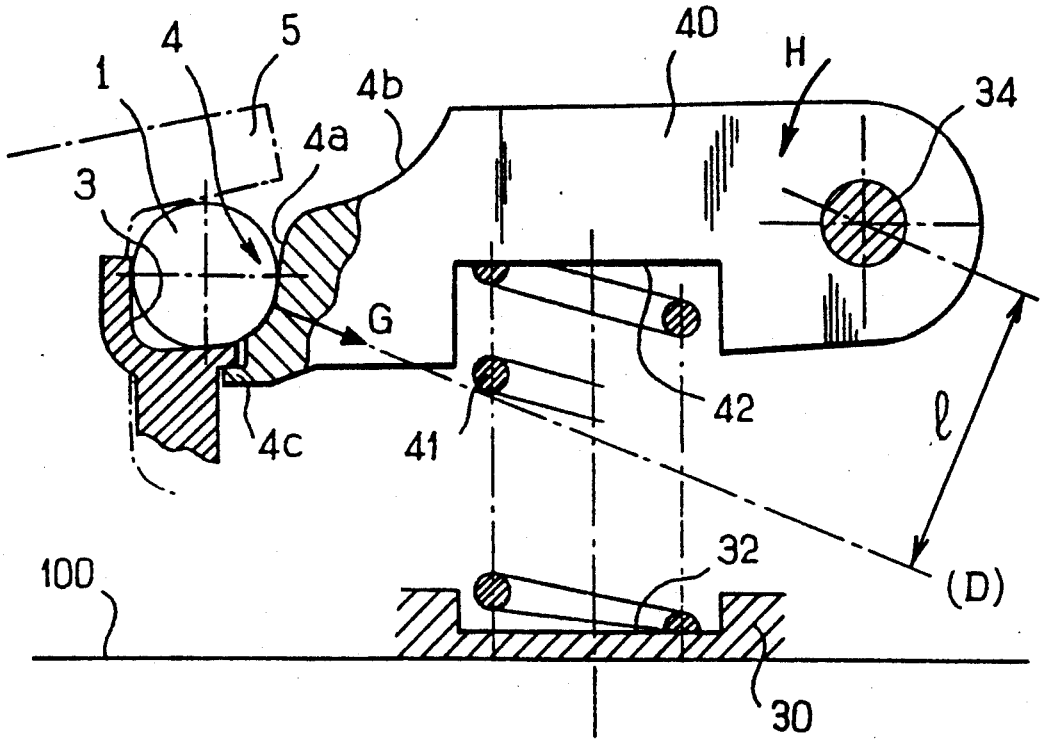
FIGS. 3 and 3A are details of FIG. 1 illustrating the positions of the portion of the movable channel, before and during escape of the bar.

According to the invention, the retention channel of bar 1 is constituted by two portions, namely a fixed portion 3 and a movable portion 4. As is seen more particularly in FIG. 3, fixed portion 3, affixed to base plate 30, constitutes a support wall towards the front of bar 1, thereby defining a forward limit for the retention channel.

Movable portion 4, having a surface defining a rearward limit for the retention channel against which is supported the rear of bar 1, is constituted by the front contoured wall of a lever 40. This lever is journalled at the rear around a transverse axis of axle 34 which is carried by a fixed cap 33. A compression spring 41, positioned vertically, is supported at its lower end by a cup 32 provided in the base plate 30 and by its upper end in a reinforcement 42 provided under lever 40. This spring tends to constantly lift the front end of lever 40, which lifting is limited by an abutment 4c which is supported against a shoulder provided in the fixed portion 3 (see FIG. 3).

When the lever 40 is lifted, the portions 3 and 4 constitute a channel serving as a housing for the bar 1.

In the course of normal skiing, bar serves as a rotational axis for the pivoting of the tip of the boot on the ski.

Figure 2:
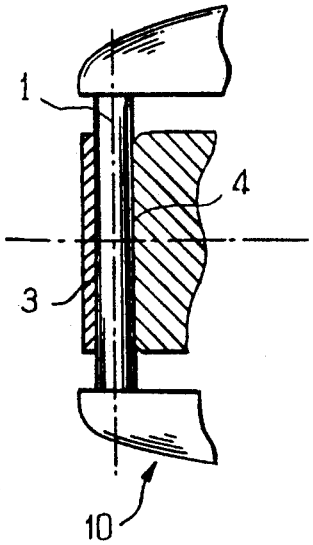
FIGS. 2 and 2A are detailed, cross-sectional views illustrating the action of the bar in the retention channel in two portions.
Figure 2A:
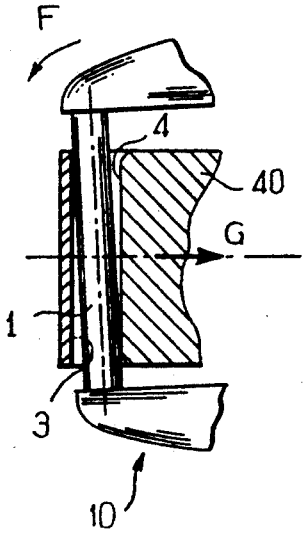
Figure 3A:
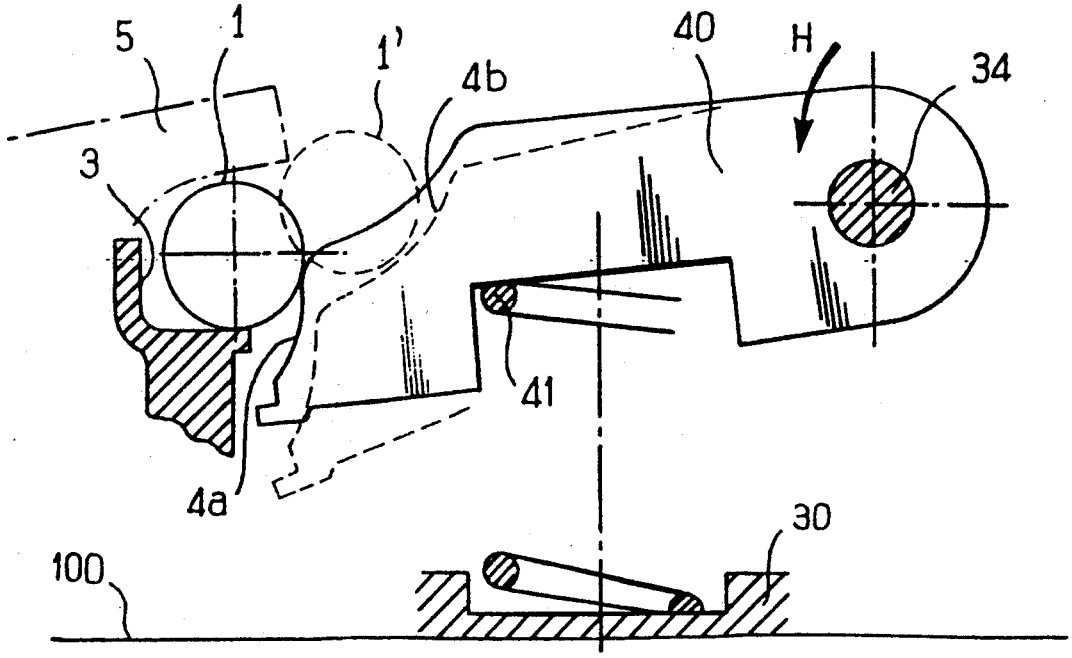

If it happens, particularly during a fall, that a relatively high torsional force develops between the shoe (and, correspondingly, the bar) and the ski, bar 1 tends to rock in the channel in the direction of arrow F, FIG. 2A. Bar 1 is thus supported at one of its ends against the fixed portion 3 and at the other end against the movable portion 4. The forces which develop on the portion 4 have, due to the configuration of the support zone between the bar and the portion 4, a resultant G whose direction D passes under the axis of axle 34 (see FIG. 3). If the moment corresponding to the product of this force by its lever arm l with respect to the axis of axle 34 is sufficient to overcome the stiffness of spring 41, calibrated to this end, as well as friction, there results a downward pivoting of lever 40 in the direction of arrow F in FIGS. 3 and 3A.

The wall of movable portion 4 has a lower portion 4a in the form of a portion of a cylinder, and this portion is connected towards the top to a disengaging wall 4b which is inclined upwardly and towards the rear in a slightly concave shape. Consequently, beyond a certain extent of lowering of lever 40, there appears at the rear of bar 1 a disengagement space, as is illustrated in dashed lines in FIG. 3A. The bar, designated 1' in dashed lines, can thus escape upwardly and towards the rear passing under latch 5, and the shoe is freed.

The safety mechanism 40, 41, 34, 33 dimensioned so as to lodge within the longitudinal groove 11 of the shoe which, in a well known manner, is provided under the sole of the shoe so as to assure the relative guidance of the shoe with respect to the ski in the lateral direction. As for the rest, the binding is preferably extended towards the rear by a guidance rib 39 (see FIG. 1) adapted to cooperate with this groove 11. Of course, a certain play must be provided between groove 11 of the shoe and lever 40 such that the forces are effectively transmitted by the bar to the movable portion (and not directly absorbed by the lever).

Preferably, the guidance rib 39 is pivotally mounted in a plane parallel to the upper surface of the ski, so as to facilitate disengagement of the shoe.

Figure 4:
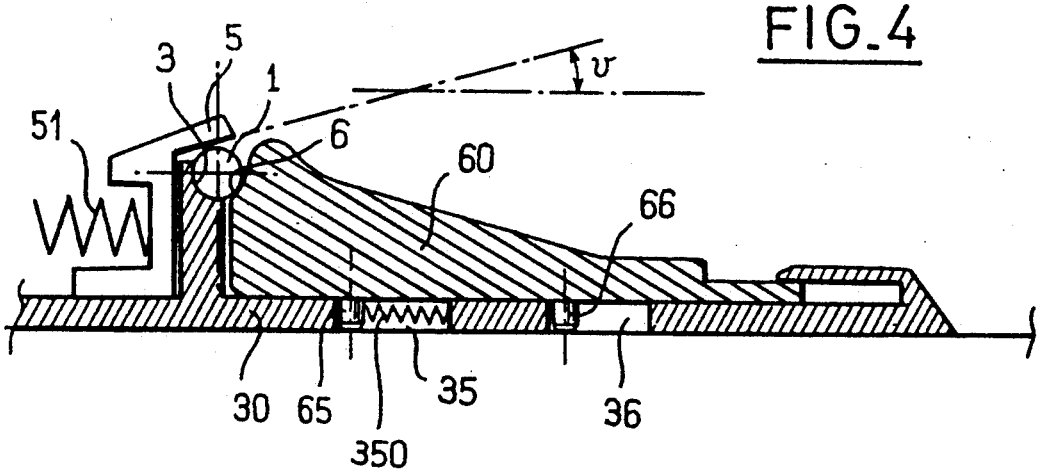
FIG. 4 is a schematic and cross-sectional side view of a second embodiment of the invention.
Figure 5:
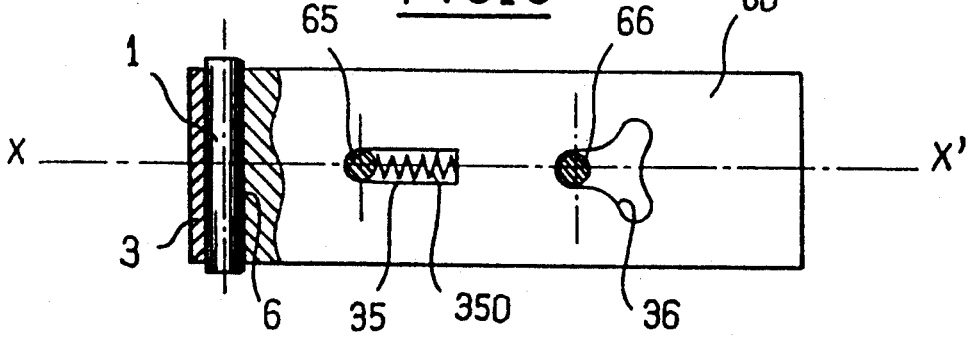
FIGS. 5 and 5A are elevational views, schematically illustrating the retraction and rocking movements of the movable channel portion.

In the second embodiment which is shown in FIGS. 4 and 5, the portion of the fixed channel 3 and the latch 5 are similar to that of the first embodiment. However, the movable channel portion is carried not by a journalled lever, but by a slide 60 which is longitudinally movable with respect to the fixed base plate 30. This slide plays the role of a guidance rib. The lower surface of the slide 60 carries two small cylindrical heads 65 and 66 positioned behind one another on the longitudinal axis XX' of the ski.

The front head 65 is housed in a longitudinal slot 35 provided in the plate 30. A compression spring 350 likewise positioned in the slot 35 pushes the head 65, and correspondingly the slide 60, towards the front of the ski, which assures the support of the movable channel portion 6 against the bar 1. The rear head 66 is housed in an opening 36 which when seen from above has the general shape of a "Y". This shape is adapted to ensure the longitudinal guidance of the head 66 along the axis XX' on a limited path, and then to allow for a lateral displacement of the head from one side to the other. To facilitate displacement of the head in the opening 36, the central arm of the "Y" is connected to the two lateral arms by curved walls, without sharp angles.

Of course, it would likewise be possible to invert this configuration by providing heads on the fixed plate and the openings in the slide.

Figure 5A:
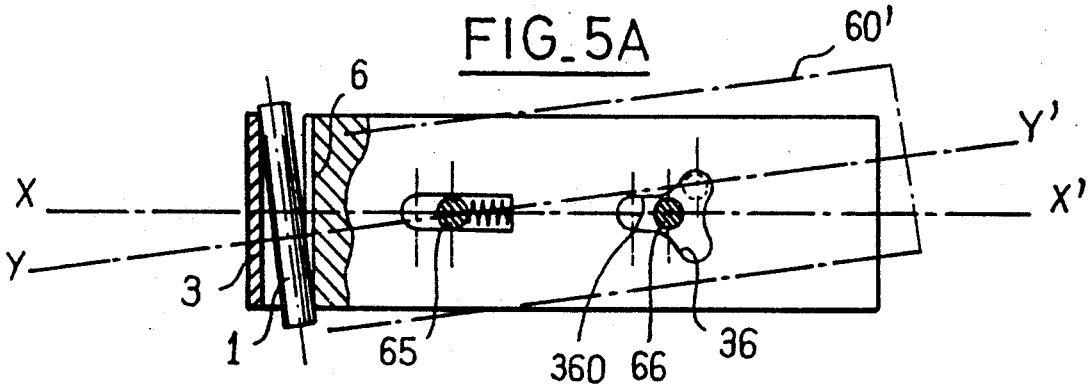

As is seen in FIG. 5A, when as a result of a torsional force, bar 1 tends to rock in the channel 3 and 6, the slide 60 is pushed towards the rear, biasing the return spring 350 in compression. After a certain extent, when the head 66 has left the rectilinear portion of the fixed hole 36, this head 66 can laterally escape into one of the lateral cutouts of the hole. This results in a lateral displacement of the slide 60 which pivots around the front head 65, while continuing its translational movement towards the rear.

In FIG. 5A, reference 60' designates and represents in dashed lines the rocked position of the slide, its longitudinal axis YY' being angularly offset with respect to the axis XX' of the ski.

Figure 4A:
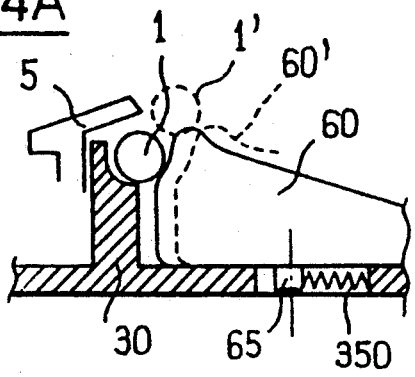
FIG. 4A is a detailed view corresponding to FIG. 4 in the course of release of the binding.

FIG. 4A illustrates the escape of the bar 1 (designated 1') as a result of the retraction and rocking movement of slide 60. While being displaced, the movable law 6 accompanies in a natural manner the trajectory of the bar, which renders the escape particularly clean and effective.

Figure 4B:
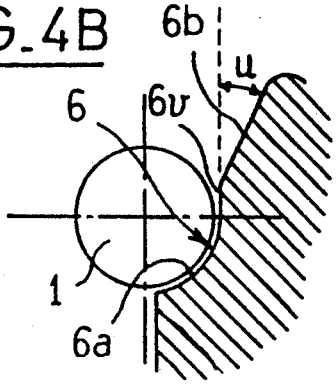
FIG. 4B is a large scale view illustrating the shape of the movable portion of the channel.

As is seen in FIG. 4B, the movable wall 6 has a lower portion **6*a* in the form of a quarter of a circle. This extends upwardly by a vertical portion 6*v* of a small height, then by a plane portion, which is inclined towards the rear and upwardly at an acute angle u with respect to the vertical line. As in the first embodiment, the surface 6*b* provides for the bar 1** a disengagement space which facilitates its escape.

As is seen in FIG. 4, the lower surface of latch 5 is preferably inclined upwardly and towards the rear by an acute angle v with respect to the horizontal line. The angles v and u favor the escape of the bar in the case of a front combined torsional fall, and even in a purely frontward fall, if these angles selected are large enough. Such an apparatus is the object of French application 89 05169 in the name of the assignee, the disclosure of which is hereby incorporated by reference thereto.

Figure 6:
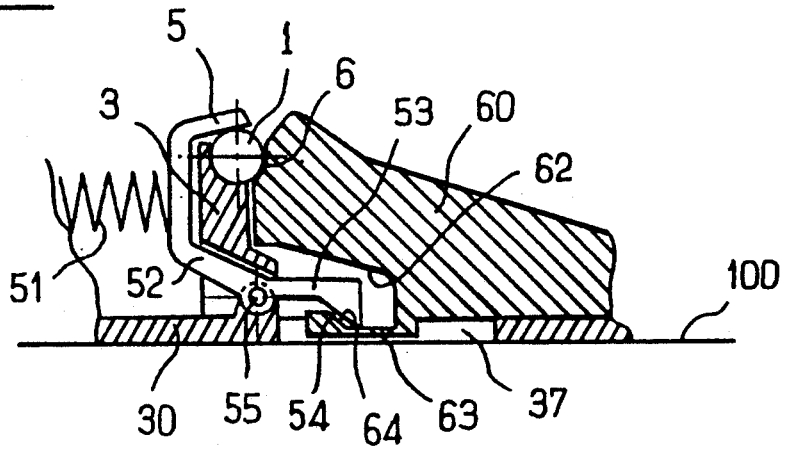
FIGS. 6 and 6A are schematic and partial views illustrating one embodiment of the binding of the FIG. 4.
Figure 6A:
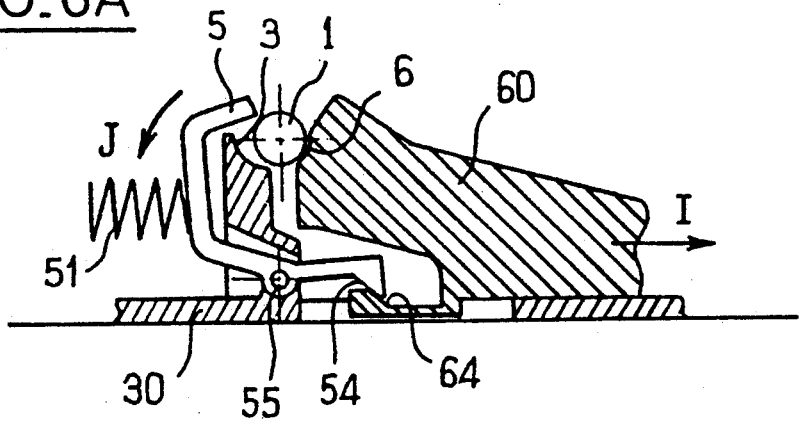

FIGS. 6 and 6A illustrate an alternative binding in which latch 5 is carried by a lever 52 which is journalled around a transverse axis of an axle 55 carried by base plate 30 approximately perpendicularly to the space separating the portions of the fixed channel and movable channel portions 3 and 6 respectively. This lever has a lever arm 53 which extends towards the rear of the ski and carries an oblique ramp 54 directed downwardly and towards the rear. This ramp is positioned to be supported against a complementary ramp 64 which is formed on an appendix 63 affixed to the slide 60. In the latter there is provided a space 62 in which is positioned the arm 53. Slide 60 can be similar to that of FIG. 4, and comprise guide and pivot heads 66 and 65 which are not shown.

When the slide 60 is pushed towards the rear (in the direction of arrow I, FIG. 6A), particularly as a result of a torsional moment produced between the shoe and the ski, its retraction causes the lifting of arm 53 by means of control ramps 64 and 54. The latch 5 thus pivots towards the front (in the direction of arrow J) by compressing spring 51. The latch leaves, consequently, its blocking position of the channel, such that the escape of the bar 1 is facilitated.

Figure 7:
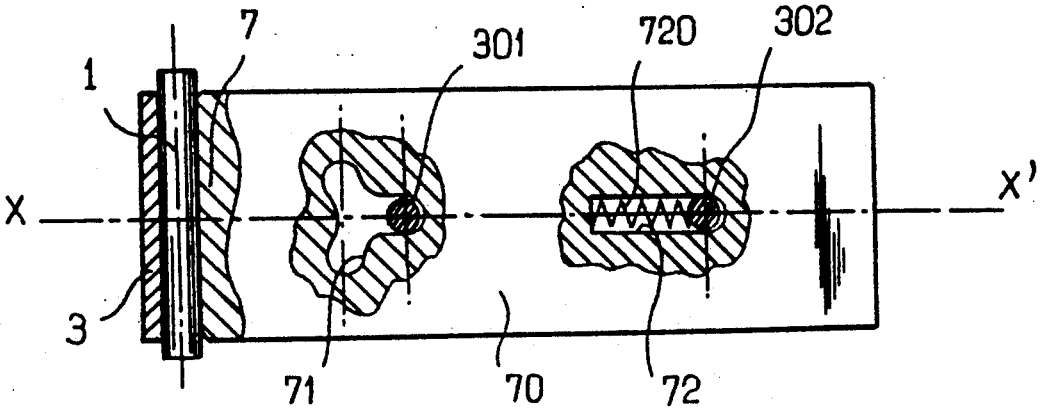
FIG. 7 and 7A on the one hand, as well as FIGS. 8 and 8A on the other hand, schematically illustrate possible alternatives for the pivotable mounting of the movable portion on the ski, FIGS. 7A and 8A illustrating the binding in the course of release.

In the embodiment shown in FIG. 7, the movable channel portion, shown with numeral 7, is carried by a slide 70 which, as is the case with slide 60, can slide both longitudinally along axis X' and pivot laterally to accompany the bar 1. The means to assure the translational guidance and lateral pivoting of the slide consists likewise of a hole 71 in the form of a "Y" and of an elongated slot 72. However, in the present embodiment, the slots are provided not only in the base plate 30, but in the slide 70. Conversely, the heads 301, respectively 302, which penetrate into the hole 71 and 72 are carried by the base plate, and are thus fixed. As a result, the arrangements are inverted, and the return spring 720 is supported on the head 302 in order to push the slide 70 towards the front.

Figure 7A:
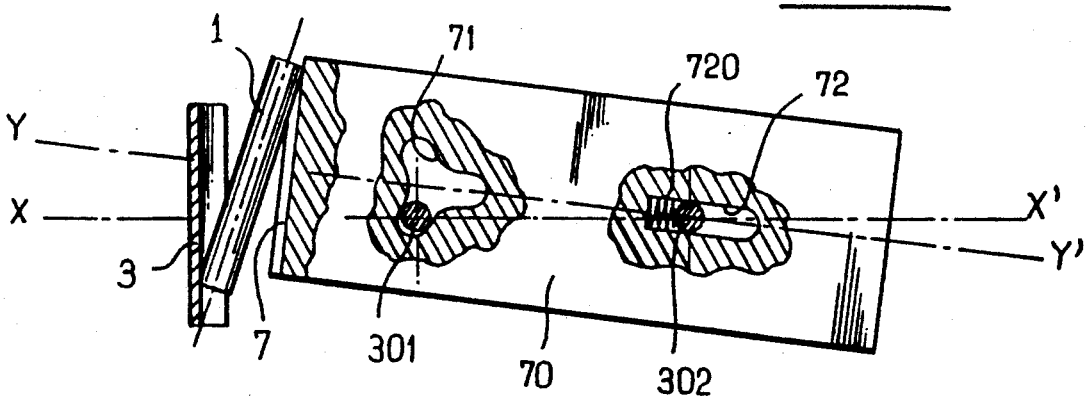

The rear head 302 serves as a pivot axis, beyond a certain path of pure axial translation, as is illustrated in FIG. 7A.

Preferably, the rocking axis 302 can be positioned in the area defined by the metatarsus which can be useful for certain skiers, particularly those skiers who use the "telemark" style.

Figure 8:
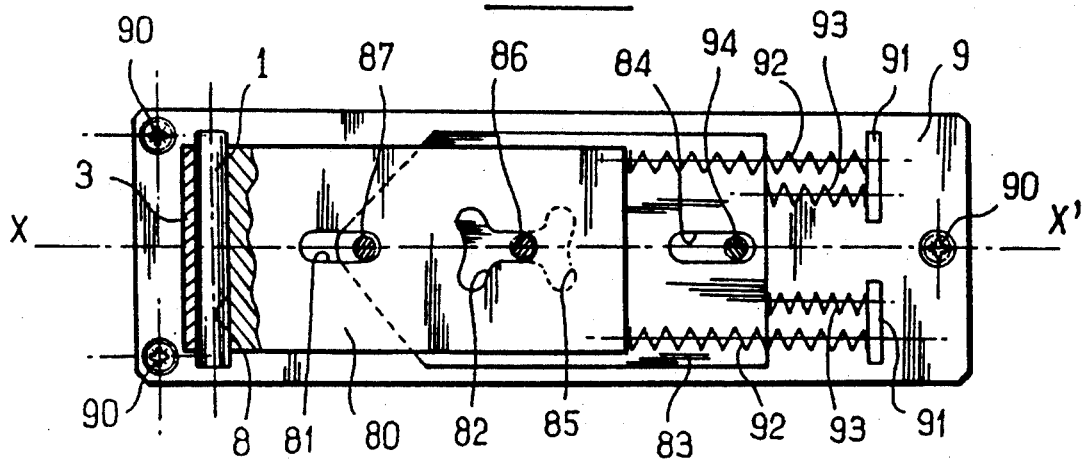

The embodiment in FIG. 8 combines the embodiments of FIGS. 5 and 7 in a single apparatus.

This apparatus comprises a base plate 9, which is affixed on the ski by means of screw 90. The movable channel portion 8 is carried by a plate 80 which is mounted with the possibility of retraction and pivoting on an intermediate plate 83. This intermediate plate can itself retract and pivot on the base plate 9.

For this, the base plate is provided at the rear with a fixed head 94 and, at the front, an opening 85 in the form of a "Y". In the slide 80, there is provided in the front, an elongated slot 81 and an opening 82 in the form of a "Y", which is inverted with respect to opening 85.

The linkage between the slide 80 and the intermediate plate 83 is assured on the one hand by a head 87 mounted in front of the plate 83 and which penetrates into the slot 81, and on the other hand by a movable head 86 which can be freely displaced in each of the openings 82 and 85. The fixed head 94 is positioned substantially at the level of the journal of the metatarsus.

Two sets of springs 92 and 93, respectively, which are supported against fixed abutments 91 act respectively against slide 80 and plate 83 to assure their centering along axis XX' of the ski.

Figure 8A:
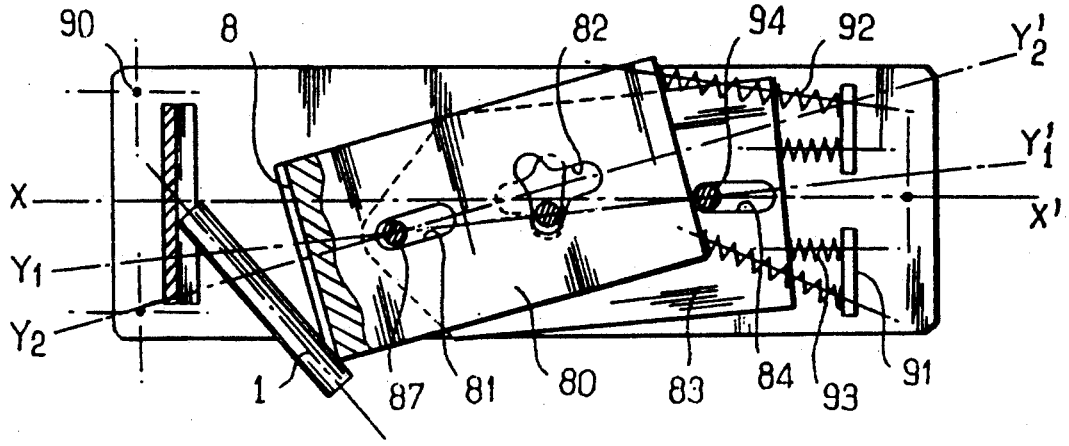

As can be seen clearly from FIG. 8A, this embodiment enables a double rocking of the movable portion 8 in the course of release, which is useful for a better accompaniment of the bar 1. In this embodiment, one obtains a release not only for the same force configurations as in the embodiments in FIGS. 4, 5 and 7, but also for torsional movements occurring in the metatarsal axis.

Thus, in the case of a force applied at the level of the tip of the foot, i.e., transmitted essentially through the bar 1, it is only the front plate 80 which is displaced while freeing the bar, the intermediate plate 83 remaining fixed.

In the case of a force applied essentially at the level of the journal of the metatarsus, it is plate 83 which is biased and displaced laterally, by sliding the head 86 into the opening 85, the plate 80 remaining fixed. This displacement comprises a pivoting whose axis is at the head 94. To facilitate this movement, the central arm of the "Y" opening 85 is preferably of reduced, almost zero length, this opening thus being bean-shaped.

In the case of forces applied both to the top of the shoe and in the area defined by the metatarsus, the two plates 80 and 83 can be displaced simultaneously, as shown in FIG. 8A.

Finally, although the invention has been described with particular means, materials and embodiments, it is to be understood that the invention is not limited to the particulars disclosed and extends to all equivalents within the scope of the claims.

What is claimed is:

1. A safety binding for a cross country ski, said binding comprising:

retention means for a front portion of a shoe to be retained on the ski by means of the binding, said retention means comprising:

a base adapted to be affixed to an upper ski surface;

a channel affixed to said base, said channel having an upwardly facing opening, said channel being formed by a fixed portion and a movable portion, the movable portion being adapted to be spaced from the fixed portion;

a transverse latching bar nested in said channel, said latching bar being carried by a front portion of the shoe;

a latch movably connected to said base, said latch being adapted to normally block the opening of the channel during skiing to prevent the bar from escaping from the channel; and an elastic return means having a portion affixed to said base and another portion positioned with respect to the movable portion to apply an elastic force against the movable portion against the effect of a longitudinal force applied in a direction to free the bar.

2. The binding as defined by claim 1, wherein the channel comprises a rear portion constituted by the movable portion of the channel.

3. The binding as defined by claim 2, wherein the movable portion comprises a lower portion having substantially the shape of a quarter of a cylinder, which is connected to a disengagement surface inclined upwardly and rearwardly.

4. The binding as defined by claim 1, further comprising means for mounting the movable portion for downward pivoting relative to the fixed portion, wherein said downward pivoting results in a spacing of the movable portion relative to the fixed portion.

5. The binding as defined by claim 4, wherein that means for mounting the movable portion comprises a lever which is journalled around a transverse axis for said downward pivoting and said spacing of the movable portion with respect to the fixed portion.

6. The binding as defined by claim 1, further comprising means for mounting the movable portion for displacement relative to the fixed portion in a longitudinal direction.

7. The binding as defined by claim 6, further comprising a slide mounted for translational displacement along the longitudinal direction of the ski.

8. The binding as defined by claim 7, further comprising means for facilitating, after a predetermined path of longitudinal translation, lateral movement of the slide relative to the ski.

9. The binding as defined by claim 8, further comprising an intermediate plate and means for facilitating sliding and pivoting of the slide on the intermediate plate, said intermediate plate further comprising means for adapting said intermediate plate to slide and pivot relative to the ski, independently of the slide.

10. The binding as defined by claim 9, wherein said means for adapting said intermediate plate to slide and pivot relative to the ski further comprises means for adapting said intermediate plate to pivot around an axis positioned substantially at an area defined by the metatarsus.

11. The binding as defined by claim 1, further comprising means for functionally connecting the movable channel portion to said latch for causing a retraction of the latch during a spacing movement of said movable portion, said spacing movement of said movable portion facilitating escape of the bar out of the channel.

12. The binding as defined by claim 11, said means for functionally connecting the movable channel portion to said latch further comprises a journalled lever carrying said latch, wherein pivoting of said lever produces the retraction of the latch, and two ramps, affixed respectively to said movable portion and to said lever, for producing said pivoting of said lever.

13. The binding as defined by claim 1, in combination with a guidance rib adapted to be pivotably mounted on the ski.

14. The binding as defined by claim 8, said means for facilitating lateral movement of the slide comprises means for facilitating a lateral pivotal movement relative to the ski.

15. A binding for retaining at least a part of a ski shoe on a cross country ski, said binding comprising:

a base adapted to be affixed to an upper ski surface;

a first member fixed to said base and having a portion defining a forward limit of a generally transverse channel;

a second member having a portion for defining a rearward limit of the generally transverse channel;

a device for mounting the second member on the base for movement of the rearward limit of the channel away from the forward limit of the channel;

a return biasing device connected for opposing the movement of the rearward limit of the channel away from the forward limit of the channel; and a latch movably connected to the base and being positioned relative to the channel to obstruct movement of the part of the ski shoe from the transverse channel of the binding.

16. A binding as defined by claim 15, further comprising a slide mounted for longitudinal movement relative to the base, the latch mounted to the slide for movement with the slide, and a further biasing device, said further biasing device having a portion fixedly connected with respect to the base and another portion connected with respect to the slide for opposing said longitudinal movement of the slide in a direction away from the second member.

17. A binding as defined by claim 15, the part of the ski shoe comprising a transverse axle positioned below a lower forward portion of the shoe, said ski shoe further having a longitudinal groove in a lower forward portion of the ski shoe, said second member having a size and shape for reception in the longitudinal groove in the lower forward portion of the ski shoe in a locked position of the binding, in which the transverse axle is received in the transverse channel formed by the first member and the second member of the binding.

18. A binding as defined by claim 15, the device for mounting the second member for movement of the rearward limit of the channel away from the forward limit of the channel comprising a pivot mechanism for mounting the second member for pivoting downwardly about a transverse axis positioned rearwardly of the channel, and the return biasing device being positioned between the base and the second member for presenting a generally upwardly directed biasing force against the second member.

19. A binding as defined by claim 18, the channel having a generally transverse channel axis, the channel axis being located closer to a lower surface of the base than the transverse axis of the pivot mechanism.

* * * * *